US006286342B1

(12) United States Patent
Truffelli et al.

(10) Patent No.: US 6,286,342 B1
(45) Date of Patent: Sep. 11, 2001

(54) CIRCULAR KNITTING MACHINE WITH DEVICE FOR PRODUCING TUBULAR ITEMS CLOSED AT AN AXIAL END, AND METHOD FOR PRODUCING TUBULAR ITEMS

(75) Inventors: Gianfranco Truffelli, Pontassieve; Stefano Gabbrielli, Firenze, both of (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/801,684

(22) Filed: Mar. 9, 2001

(30) Foreign Application Priority Data

Mar. 20, 2000 (IT) ..... MI20A0581

(51) Int. Cl.[7] ..... D04B 9/56
(52) U.S. Cl. ..... 66/148
(58) Field of Search ..... 66/8, 13, 95, 104, 66/147, 148

(56) References Cited

U.S. PATENT DOCUMENTS 5,617,744 * 4/1997 Conti ..... 66/148
5,647,229 * 7/1997 Conti ..... 66/148
6,044,668 * 4/2000 Conti ..... 66/148

FOREIGN PATENT DOCUMENTS

1635992 * 7/1971 (DE) ..... 66/148
0592376 * 4/1994 (EP) ..... 66/148
2045000 * 2/1971 (FR) ..... 66/148

* cited by examiner

*Primary Examiner*—Danny Worrell
(74) *Attorney, Agent, or Firm*—Guido Modiano; Albert Josif; Daniel O'Byrne

(57) ABSTRACT

A circular knitting machine for hosiery, with a device for producing tubular items closed at an axial end, and relative method. The machine has a diverter accommodated inside the needle cylinder disengaged from the rotation of the needle cylinder about its own axis with respect to the needle actuation cams and to the lowering sinker actuation cams. The diverter has a profile which protrudes from an internal region of the needle cylinder gradually toward the wall of the needle cylinder. The profile is engaged by an end portion of the item lying inside the needle cylinder between two needles mutually angularly spaced around the axis of the needle cylinder in order to achieve sliding of the item portion along the profile following rotation of the needle cylinder with respect to the diverter. The machine has sinkers for retaining the item portion against the profile during its sliding.

15 Claims, 3 Drawing Sheets

CIRCULAR KNITTING MACHINE WITH DEVICE FOR PRODUCING TUBULAR ITEMS CLOSED AT AN AXIAL END, AND METHOD FOR PRODUCING TUBULAR ITEMS

BACKGROUND OF THE INVENTION

The present invention relates to a circular knitting machine for knitting hosiery or the like, with a device for producing tubular items closed at an axial end and to a method for producing tubular items.

It is known that hosiery items, according to the conventional method of production with circular hosiery knitting machines, are unloaded from the machine that produces them with their toe open and must then be subjected to stitching or looping on appropriate machines in order to obtain the finished product.

In view of the fact that the toe stitching or looping operation significantly affects the overall production costs of hosiery items, methods and machines which allow to obtain closed-toe hosiery items directly on the machine that produces them have been studied and improved in recent years.

One of these methods is disclosed in Italian Patent no. 1,286,604 and substantially consists in forming the hosiery item on a single-cylinder circular machine by starting from the toe and formation initially a pocket by using the needles that belong substantially to one half of the needle cylinder. The initial border of the pocket, at the end of its formation, remains free inside the needle cylinder, while the final border of the pocket is retained on the needles of the half of the needle cylinder that formed it. The initial free border of the pocket is subjected to suction in a region located inside the needle cylinder. Substantially, a region of concentrated air suction is provided inside the needle cylinder and gradually affects the initial free border of the pocket as a consequence of the rotation of the needle cylinder about its own axis with respect to said concentrated air suction region. In this manner, the initial free border of the pocket is captured and gradually engaged by appropriately provided elements being constituted by particular lowering sinkers which have a point at the upper end of their nose. By the action of these lowering sinkers, the initial border of the pocket is gradually transferred above the needles of the half of the needle cylinder that did not form the pocket, so that through subsequent lifting of the needles said initial border of the pocket is crossed by the needles that did not take part in the formation of the pocket. At the end of this operation of transferring the initial border of the pocket onto the needles of the half of the needle cylinder that lies opposite the half used to form the pocket, the entire border that delimits the pocket is engaged with the needles of the needle cylinder, which are actuated so as to continue formation of the item in the conventional manner, thereby forming a hosiery item which is closed at its toe.

The concentrated air suction region, in known types of machines that perform this method, is generally constituted by a suction port, the intake whereof is located proximate to the upper end of the needle cylinder and has a profile which, according to the rotation of the needle cylinder about its own axis with respect to the suction port, gradually approaches the cylindrical wall of the needle cylinder, so that the initial border of the pocket, by engaging said profile, is gradually moved toward the needles designed to receive said initial border of the pocket, in order to allow the lowering sinkers, provided with said point, to engage said initial border in order to transfer it above said needles.

For the successful transfer of the initial border of the pocket to the needles designed to receive it, such initial border must remain constantly engaged with the profile of the suction port. If the initial border, as a consequence of the knitting process and of the yarns used for its production, is not sufficiently resilient, said initial border can disengage from the profile of the suction port, and therefore the initial border of the pocket, instead of moving gradually toward the needles that must engage it, escapes toward the axis of the needle cylinder, making it impossible for the lowering sinkers to engage it and thus making it impossible to transfer one or more parts of the initial border onto the needles that are designed to receive it.

SUMMARY OF THE INVENTION

The aim of the present invention is to provide a single-cylinder circular knitting machine for hosiery which can produce tubular items being closed at an axial end and which solves this problem effectively. Within the scope of this aim, an object of the invention is to provide a machine which can effectively transfer the initial border of a pocket, formed by using the needles that belong substantially to one half of the needle cylinder, to the needles that belong to the other half of the needle cylinder, even without having to use a region of concentrated suction inside the needle cylinder.

Another object of the invention is to devise a method which allows to produce, on a single-cylinder circular knitting machine for hosiery, tubular items which are closed at an axial end with fully satisfactory results both from a functional and from an aesthetic point of view.

This aim and these and other objects which will become better apparent hereinafter are achieved by a circular knitting machine for hosiery or the like with a device for producing tubular items closed at an axial end, comprising a needle cylinder which has a vertical axis and has, on its cylindrical wall, a plurality of axial slots, each of which accommodates a needle which can be actuated, by way of actuation cams arranged around the cylindrical wall of the needle cylinder, in order to form knitting; a sinker ring being arranged proximate to the upper end of the needle cylinder, being rigidly coupled to the needle cylinder and having a plurality of radial slots, each of which accommodates a lowering sinker; cams being provided for actuating the lowering sinkers which face said sinker ring and can be engaged by said sinkers, said needle cylinder being actuatable with a rotary motion about its own axis with respect to said needle actuation cams and to said sinker actuation cams; characterized in that it comprises a diverter which is accommodated inside the needle cylinder and is disengaged from the rotation of the needle cylinder about its own axis with respect to said actuation cams; said diverter having a profile which protrudes from an internal region of the needle cylinder gradually toward the cylindrical wall of the needle cylinder, said profile being engageable by an end portion of the item which lies inside the needle cylinder between two needles which are mutually angularly spaced around the axis of the needle cylinder for the sliding of said portion of the item along said profile as a consequence of the rotation of the needle cylinder about its own axis with respect to said diverter; means being provided for retaining said portion of the item against said profile during its sliding along said profile.

Further characteristics and advantages of the invention will become apparent from the description of a preferred but not exclusive embodiment of the machine according to the invention, illustrated only by way of non-limitative example in the accompanying drawings, wherein:

DESCRIPTION OF THE PREFERRED EMBODIMENTS

Figure 1:
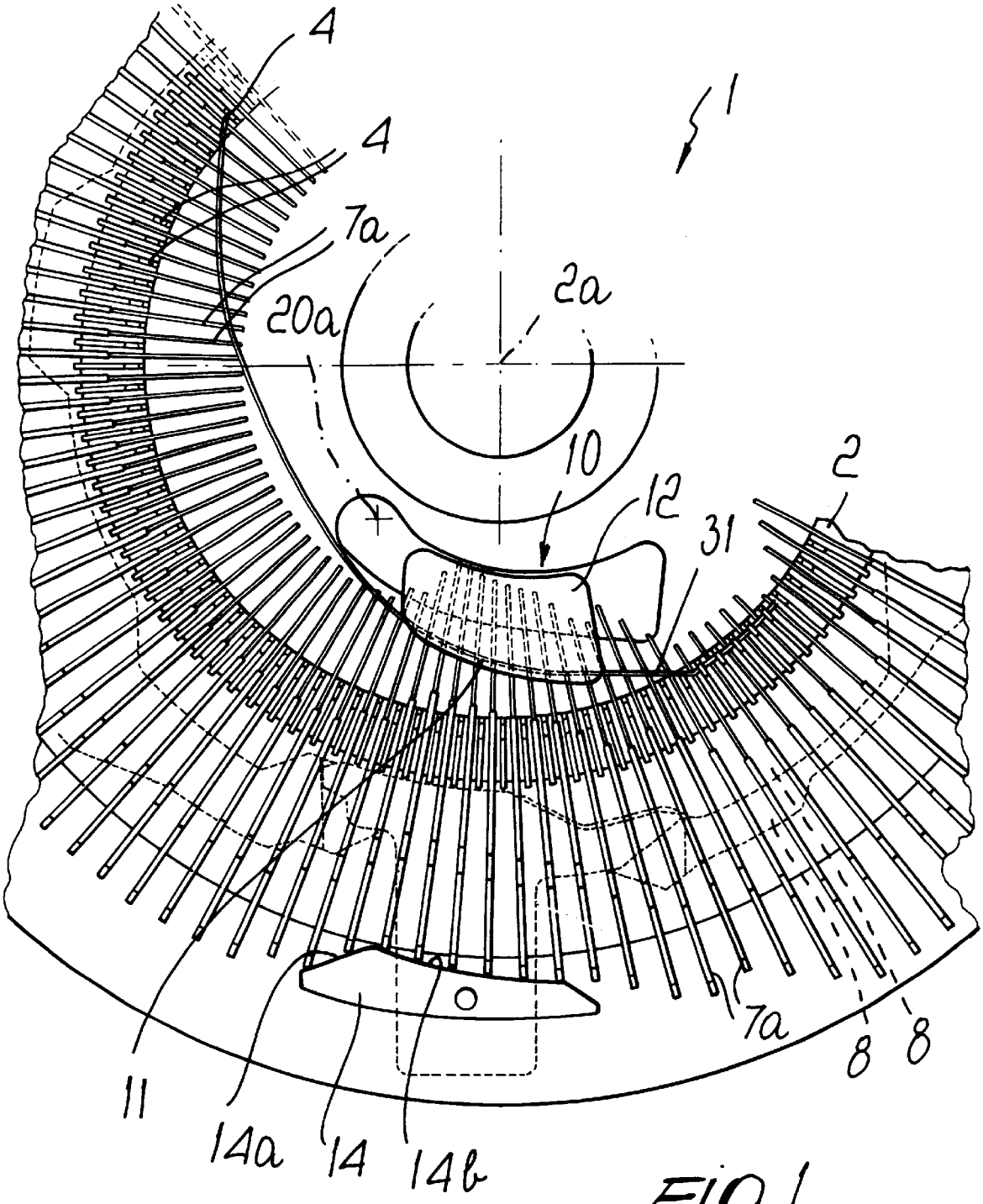
FIG. 1 is a schematic top plan view of a portion of the machine according to the invention.
Figure 2:
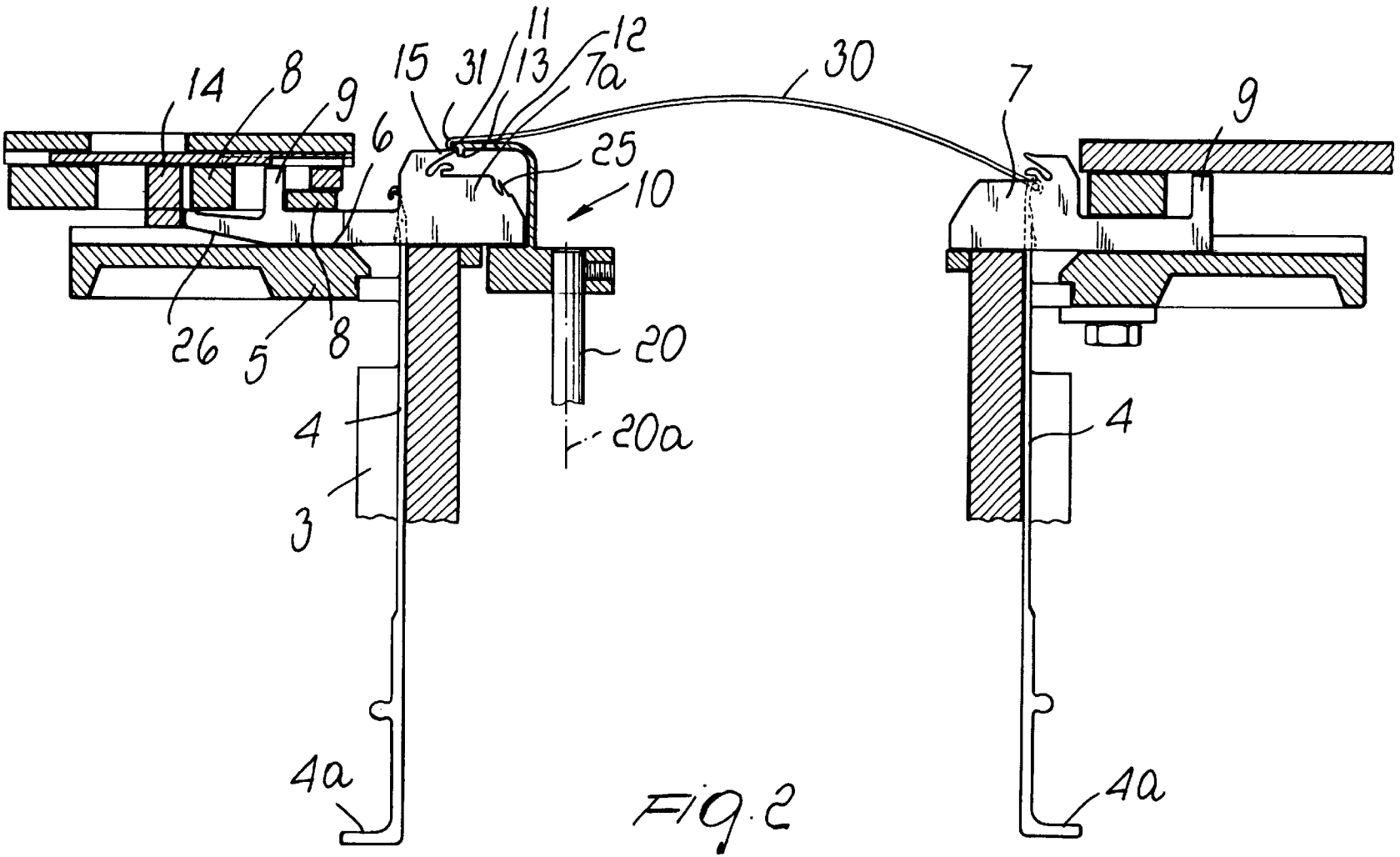
FIG. 2 is a schematic axial sectional view of the upper portion of the needle cylinder of the machine according to the invention.
Figure 3:
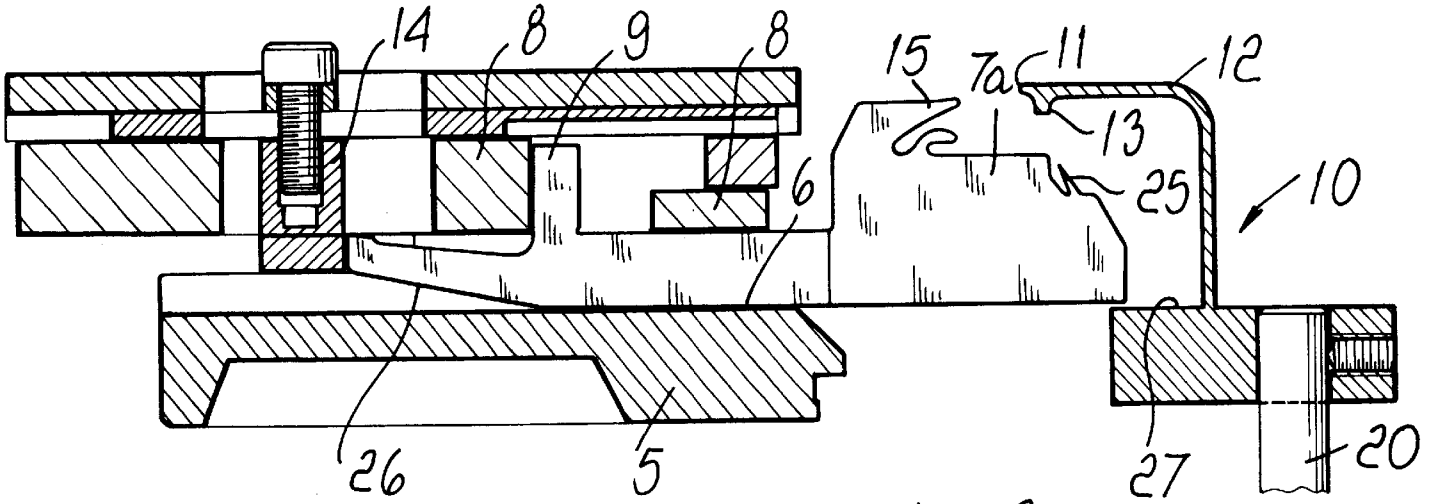
FIG. 3 is an enlarged-scale view of a detail of FIG. 2 before the engagement of the retention means with the item.
Figure 4:
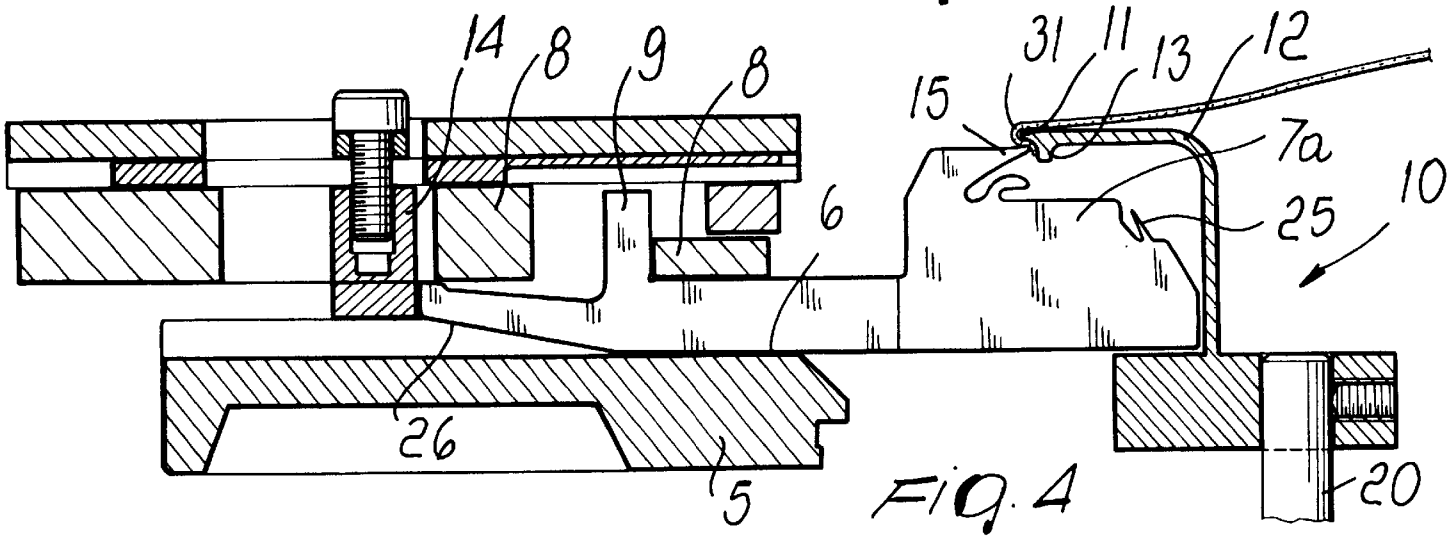
FIG. 4 is a view of the same detail as FIG. 3, with the retention means engaged with the item.

With reference to the figures, the machine according to the invention, generally designated by the reference numeral 1, comprises in a per se known manner a needle cylinder 2 which has a vertical axis 2*a* and has, on its cylindrical wall, a plurality of axial slots 3, each of which accommodates a needle 4.

Cams for actuating the needles 4 are arranged around the cylindrical wall of the needle cylinder 2 and form paths which can be engaged, as a consequence of the rotation of the needle cylinder 2 about its own axis 2*a* with respect to said actuation cams, by the heel 4*a* of the needles 4, so as to obtain, in a per se known manner, an actuation of the needles 4 along the corresponding axial slots 3 of the needle cylinder 2 in order to form knitting.

Proximate to the upper end of the needle cylinder 2 there is a sinker ring 5 having a plurality of radial slots 6, each of which internally accommodates a lowering cam 7, 7*a*. The radial slots 6 of the sinker ring 5 are appropriately staggered with respect to the axial slots 3 of the needle cylinder 2 about the axis 2*a*, so that each sinker 7, 7*a* lies between two contiguous needles.

The sinker ring 5 is rigidly coupled to the needle cylinder 2 in rotating about the axis 2*a*, and sinker actuation cams 8 face from above the sinker ring 5 and form paths which can be engaged by a heel 9 of the sinkers 7, 7*a* as a consequence of the rotation of the needle cylinder 2, and therefore of the sinker ring 5, about the axis 2*a* with respect to the actuation cams 8. Such paths are shaped, in a per se known manner, so as to actuate the sinkers 7, 7*a* along the corresponding radial slots 6 toward or away from the axis 2*a*, so that the sinkers 7, 7*a* cooperate with the needles 4 in forming knitting, as in conventional-type single-cylinder circular machines.

The machine according to the invention comprises a diverter 10 which is accommodated inside the needle cylinder 2 and is disengaged from it in its rotation about the axis 2*a* with respect to the actuation cams of the needles 4 and to the actuation cams 8 of the sinkers 7, 7*a*.

The diverter 10 has a profile 11 which, depending on the rotation of the needle cylinder 2 with respect to said diverter 10, gradually approaches the cylindrical wall of the needle cylinder 2. Such profile 11 can be engaged by an end portion of the item 30 which is produced by the machine, as will become apparent hereinafter, and lies inside the needle cylinder between two needles which are mutually angularly spaced around the axis 2*a* of the needle cylinder 2 in order to achieve the sliding of said portion of the item 30 along the profile 11 as a consequence of the rotation of the needle cylinder 2 about its own axis 2*a* with respect to the diverter 10.

The machine according to the invention further comprises means for retaining said portion of the item 30 against the profile 11 during its sliding along said profile 11.

More particularly, the profile 11 of the diverter 10 is preferably formed by a plate 12 being arranged on a plane which is substantially perpendicular to the axis 2*a* of the needle cylinder 2. Said plate 12 has a peripheral rim which is directed toward the outside of the needle cylinder 2 and can be engaged by an end border 31 of the portion of the item 30 that rests on the upper face of the plate 12.

The plate 12 has, on its lower face, a rim 13 which protrudes downwardly. Said rim 13 is spaced from the peripheral rim of the plate 12 that forms the profile 11 and is shaped so as to match said peripheral rim.

The retention means are preferably constituted by sinkers 7*a* with which substantially one half of the needle cylinder 2 is equipped.

The machine according to the invention further comprises the auxiliary means for the actuation of said sinkers 7*a* in order to move said sinkers 7*a* with one of their portions against the profile 11, so as to make contact with the border 31 of the item 30 and keep it against said profile 11 during its sliding along said profile 11.

Said auxiliary actuation means are conveniently constituted by an actuation cam 14 which faces the sinker ring 5 in the region affected by the diverter 10. The actuation cam 14 has a profile which can be engaged by the end of the sinkers 7*a* that is directed away from the axis 2*a* of the needle cylinder 2. Said profile of the actuation cam 14 has a first portion 14*a*, which is shaped so as to produce a gradual approach of the sinkers 7*a* to the axis 2*a* of the needle cylinder 2, and a second portion 14*b*, which is shaped so as to match the profile 11 of the diverter 10 so as to keep the sinkers 7*a*, which engage the cam 14, with their beak 15 adjacent to the region of the plate 12, which is located between the peripheral border that forms the profile 11 and the rim 13, substantially over the entire extension of the profile 11 of the diverter 10 that can be engaged by the border 31 of the item 30.

The cam 14 is movable on command by way of actuators of a known type which can be constituted, for example, by a pneumatic cylinder, by an electromagnetically-driven actuator or by an actuator of the mechanical type, from an active position, in which it engages the end of the sinkers 7*a* that is directed away from the axis 2*a*, to an inactive position, in which it is spaced with respect to the active position relative to the axis 2*a* of the needle cylinder 2 so as to not engage the sinkers 7*a*, and vice versa.

The diverter 10 is fixed to a supporting shaft 20 which is orientated so that its axis is parallel to the axis 2*a* and is movable on command along its own axis in order to move the diverter 10 to an active position, in which it is arranged proximate to the upper end of the needle cylinder 2 so as to engage, by means of its profile 11, the border 31 of the item 30, to an inactive position, in which it is lowered inside the needle cylinder 2 with respect to the active position in order to avoid interfering with the item 30, and vice versa.

The shaft 20 is fixed to the diverter 10 proximate to the end of the profile 11 that is engaged first by the portion of the item 30 and can be rotated, about its own axis 20*a*, so as to cause a rotation of the entire diverter 10 about the axis 20*a* in order to move the profile 11 toward or away from the cylindrical wall of the needle cylinder 2.

Conveniently, the diverter 10 has a portion 27 which is directed toward the cylindrical wall of the needle cylinder 2 and forms a substantially horizontal supporting surface which is adapted to support, in a downward region, the end of the sinkers 7*a* when they are pushed by the cam 14 toward the diverter 10.

The sinkers 7*a* preferably have, proximate to the upper end of their nose, a point 25 and can be made to oscillate on a radial plane, with respect to the needle cylinder 2, inside the corresponding radial slot 6 of the sinker ring 5. More particularly, the lower side of the sinkers 7*a*, arranged proximate to the end of the sinkers 7*a* that is directed away from the axis 2*a* of the needle cylinder 2, is shaped like an inclined plane 26 and the actuation cams of the sinkers 8 have a profile which, in the region directly after the diverter 10 along the rotation of the needle cylinder 2 about its own axis 2*a* with respect to the diverter 10, engages the upper side of said end of the sinkers 7*a*, so as to push said end toward the bottom of the corresponding radial slot 6, thus producing the oscillation of the sinkers 7*a* which makes the point 25 rise.

The machine according to the invention is equipped with sinkers 7 of the conventional type, as regards one half of the needle cylinder, and with sinkers 7*a* as regards the other half of the needle cylinder.

The operation of the machine according to the invention in the manufacture of a tubular item closed at one of its axial end is as follows.

Manufacture of the item 30 begins from the end that is to be closed by forming a pocket, as disclosed in Italian Patent no. 1,286,604, using the needles that belong to the half of the needle cylinder 2 that is equipped with the conventional-type sinkers 7.

The initial step of formation of the pocket can optionally be preceded by a step in which some rows of knitting are formed by using all the needles of the needle cylinder 2.

The pocket can be formed by actuating the needle cylinder 2 with an alternating motion about its own axis 2*a*, as in the execution of the knitting of the heel of hosiery items, of a known type, or by way of a continuous rotation of the needle cylinder 2 about its own axis 2*a*, cutting the threads at the ends of the pocket. At the end of the formation of the pocket, the initial or end border 31 of the pocket is free inside the needle cylinder 2 of the machine, while the final border is retained on the needles 4 that belong to the half of the needle cylinder 2 that was used to knit the pocket.

At this point in time the needle cylinder 2 is turned through one full turn about its own axis 2*a*, so that the initial border 31 of the pocket engages against the profile 11 of the diverter 10 moved into the active position. By way of the rotation of the needle cylinder 2 about its own axis 2*a*, the sinkers 7*a* that belong to the half of the needle cylinder that was not involved in the formation of the pocket, by engaging the cam 14, are made to engage, with the end of their beak 15, the border 31 of the pocket, retaining it firmly against the profile 11 over its entire extension. In this manner, the initial border 31 is firmly clamped between the border of the plate 12 that forms the profile 11 and the border 13 and is in any case free to slide along the profile 11 in order to gradually approach the cylindrical wall of the needle cylinder 2. The sinkers 7*a*, besides retaining the border 31 against the profile 11, also facilitate its sliding along the profile 11. Directly downstream of the profile 11, the sinkers 7*a* are raised so that their point 25 engages the portion of the initial border 31 that lies between the profile 11 and the last needle with which said border 31 is engaged. The sinkers 7*a*, actuated as disclosed in Italian Patent no. 1,286,604, gradually move the initial border 31 above the needles of the half of the needle cylinder 2 that was not involved in the formation of the pocket; said needles are then raised as to cross said initial border 31 until the entire initial border 31 is completely transferred onto the needles of the half of the needle cylinder 2 that was not involved in the formation of the pocket. At the end of the transfer, the previously formed pocket is engaged with all the needles of the needle cylinder. At this point in time, the diverter 10 is lowered inside the needle cylinder so that it no longer interferes with the item 30 and knitting continues in a per se known manner until the item is completed; the item is then unloaded from the machine according to the invention, with a closed axial end.

It should be observed that the passage of the initial border 31 above the needles 4 of the half of the needle cylinder 2 that is not used to form the pocket can also be achieved without engaging and lifting the border 31 by means of the point 25 of the sinkers 7*a*. The profile 11 of the diverter 10 may in fact be provided so that it reaches the outside of the cylindrical surface along which the needles 4 are arranged, so that the border 31 is arranged above the needles designed to receive it simply by sliding along the profile 11. In this case also, the sinkers 7*a* retain the border 31 against the profile 11 substantially along its entire extension. In this case, the sinkers 7*a* can be provided like the sinkers 7, i.e., without the point 25.

With this different embodiment, besides not requiring the use of special sinkers with the point 25, the assembly of the cams that actuate the sinkers is simplified, since it is no longer necessary to oscillate the sinkers in order to raise the border 31.

In this constructive variation, the sinkers, by keeping the border 31 against the profile 11 in the immediate vicinity of the needles that are raised to pass through said border 31, also prevent the item from rising, thus making it easier for the needles to pass through it.

In practice it has been observed that the machine according to the invention fully achieves the intended aim, since by having means for retaining the initial border of the pocket against the profile of the diverter it assuredly prevents such initial border from disengaging from the diverter and thus assuredly transfers the initial border of the pocket to the needles that belong to the half of the needle cylinder that was not involved in the formation of the pocket, and thus ensures perfectly successful production of tubular items closed at an axial end.

Although the machine according to the invention has been conceived particularly for the production of closed-toe hosiery items, it can in any case be used more generally for the production of tubular items which are closed at an axial end.

The machine thus conceived is susceptible of numerous modifications and variations, all of which are within the scope of the appended claims; all the details may furthermore be replaced with other technically equivalent elements.

In practice, the materials used, as well as the dimensions, may be any according to requirements and to the state of the art.

The disclosures in Italian Patent Application No. M12000A000581 from which this application claims priority are incorporated herein by reference.

What is claimed is:

1. A circular knitting machine with a device for producing tubular items closed at an axial end, comprising: a needle cylinder which has a vertical axis and has, on a cylindrical wall thereof, a plurality of axial slots, each of which accommodates a needle which is actuatable, by way of actuation cams arranged around the cylindrical wall of the needle cylinder, in order to form knitting; lowering sinkers; a sinker ring being arranged proximate to an upper end of the needle cylinder, being rigidly coupled to the needle cylinder and having a plurality of radial slots, each of which accommodates a lowering sinker; sinker actuation cams, which are engageable by said lowering sinkers which face said sinker ring for actuation thereof, said needle cylinder being actuatable with a rotary motion about said vertical axis with respect to said needle actuation cams and to said sinker actuation cams; a diverter, which is accommodated inside the needle cylinder and is disengaged from the rotary motion of the needle cylinder about the vertical axis with respect to said needle and sinker actuation cams; said diverter having a peripheral profile which protrudes from an internal region of the needle cylinder gradually toward the cylindrical wall of the needle cylinder, said profile being engageable by an end border portion of the tubular item which lies inside the needle cylinder between two needles which are mutually angularly spaced around the vertical axis of the needle cylinder for actuating sliding of said end portion of the item along said profile as a consequence of the rotation of the needle cylinder about said vertical axis with respect to said diverter; and retention means for retaining said end portion of the tubular item against said profile during sliding thereof along said profile.

2. The machine of claim 1, further comprising: auxiliary means for actuating the sinkers in order to move at least part of the sinkers so that a first portion thereof lies against said peripheral profile in order to contact said end border portion of the item and keep said border portion against said profile during sliding thereof along said profile, said retention means being constituted by at least part of said sinkers.

3. The machine of claim 1, wherein said peripheral profile of the diverter reaches an outside part of the cylindrical surface along which the needles are arranged in order to gradually move said end border portion above the needles.

4. The machine of claim 3, wherein said profile of the diverter is formed by a plate arranged on a plane, which is substantially perpendicular to the vertical axis of the needle cylinder, said plate having a peripheral rim which is directed toward the outside of the needle cylinder and is engageable by the end border portion of the item that rests against the upper face of said plate.

5. The machine of claim 4, wherein said plate has, on a lower face thereof, a protruding rim which protrudes downward and is spaced from said peripheral rim of the plate said protruding rim being shaped so as to match said peripheral rim; said sinkers actuated by said auxiliary actuation means retaining said end border portion of the item in a region between said peripheral border and said protruding rim.

6. The machine of claim 5, wherein the sinkers actuated by said auxiliary actuation means have a beak region which is adapted to contact said end border portion of the item that is engaged with said profile of the diverter.

7. The machine of claim 6, wherein said auxiliary means for the actuation of the sinkers comprise a sinker actuation cam which faces said sinker ring in a region faced by said diverter, said sinker actuation cam forming a path which is engageable by said sinkers; said path being shaped in order to move the sinkers that engage the path toward said diverter and in order to keep the beak of said sinkers adjacent to a region between said peripheral rim and said protruding rim substantially along the entire extension of said peripheral profile of the diverter that is engageable by the item.

8. The machine of claim 7, wherein said diverter is controllably movable, on command, along a direction which is parallel to the axis of the needle cylinder, in order to pass from an active position, in which it is located proximate to the upper end of the needle cylinder, in order to engage said end portion of the item with said peripheral profile, to an inactive position, s in which it is lowered inside the needle cylinder with respect to said active position, in order to avoid interfering with the item, and vice versa.

9. The machine of claim 8, wherein said diverter is controllably rotatable, on command, about an axis thereof, which is substantially parallel to the axis of the needle cylinder, and proximate to an end of said peripheral profile that is engaged first by said end portion of the item, for movement of said peripheral profile toward or away from the cylindrical wall of the needle cylinder.

10. The machine of claim 9, wherein said diverter has a portion which is directed toward the cylindrical wall of the needle cylinder and forms a substantially horizontal supporting surface, said supporting surface being adapted to support in a downward region an end of the sinkers pushed by said auxiliary actuation means toward said diverter.

11. A method for manufacturing tubular items closed at an axial end with a circular hosiery knitting machine or the like, comprising:

a first step for forming a pocket by using the needles of the needle cylinder that belong substantially to one half of the needle cylinder, leaving the initial border of the pocket free inside the needle cylinder, while the final border of the pocket is retained on the needles that formed it;

a second step, in which the initial border of the pocket is transferred to the needles that belong substantially to the other half of the needle cylinder;

a third step, in which the item is completed as a continuation of said pocket;

wherein transfer of the initial border of said pocket is performed by engaging said initial border of the pocket with a diverter which is arranged inside the needle cylinder and has a profile which protrudes from an internal region of the needle cylinder gradually toward the cylindrical wall of the needle cylinder and by retaining, by way of mechanical means, said initial border of the pocket on said profile during its transit along said profile produced by the rotation of the needle cylinder about its own axis with respect to said diverter.

12. The method of claim 11, wherein said transfer is completed by moving said initial border of the pocket outside the cylindrical surface along which the needles that belong to said other half of the needle cylinder are arranged.

13. The method of claim 12, wherein said initial border of the item is moved outside the cylindrical surface along which the needles that belong to said other half of the needle cylinder are arranged by way of said profile of the diverter.

14. The method of claim 12, wherein said initial border of the item is moved outside the cylindrical surface along which the needles that belong to said other half of the needle cylinder are arranged through engagement thereof and lifting on the part of the lowering sinkers arranged in said other half of the needle cylinder.

15. The method of claim 14, wherein the retention of the initial border of the pocket on said profile of the diverter is performed by way of the lowering sinkers arranged in said other half of the needle cylinder.

* * * * *